US009598851B2

(12) United States Patent
Cadogan et al.

(10) Patent No.: US 9,598,851 B2
(45) Date of Patent: Mar. 21, 2017

(54) PORTABLE FLEXIBLE SEALING DEVICE FOR GRATED OPENINGS

(71) Applicant: ILC DOVER LP, Frederica, DE (US)

(72) Inventors: David Phillip Cadogan, Middletown, DE (US); Daniel James Gleeson, Frederica, DE (US); Jonathan Michael Hinkle, Middletown, DE (US); Jeffrey Lewis Roushey, Frederica, DE (US)

(73) Assignee: ILC COVER LP, Frederica, DE (US)

( * ) Notice: Subject to any disclaimer, the term of this patent is extended or adjusted under 35 U.S.C. 154(b) by 0 days.

(21) Appl. No.: 14/507,466

(22) Filed: Oct. 6, 2014

(65) Prior Publication Data

US 2016/0097172 A1 Apr. 7, 2016

(51) Int. Cl.
*A47G 7/00* (2006.01)
*E03F 5/04* (2006.01)

(52) U.S. Cl.
CPC ..... *E03F 5/0411* (2013.01)

(58) Field of Classification Search
CPC ..... E06B 2009/005; E06B 2009/007; E06B 9/01; E06B 2009/015
USPC ..... 160/351, 371, 369; 52/202; 405/52
See application file for complete search history.

(56) References Cited

U.S. PATENT DOCUMENTS 978,718 A 12/1910 Ellington
1,007,013 A * 10/1911 Stears ..... A47K 1/14 4/293
1,081,434 A * 12/1913 Cote ..... A47K 1/14 4/293
1,169,010 A * 1/1916 Connell ..... A47K 1/14 4/293
1,981,358 A * 11/1934 Hernandez ..... A47K 1/14 4/293
2,573,223 A * 10/1951 Rust ..... E06B 9/521 160/328
2,599,725 A * 6/1952 Rust et al. ..... 160/328
2,716,448 A * 8/1955 Landess ..... E06B 9/384 160/173 R
3,032,062 A 5/1962 Blannik
3,263,580 A * 8/1966 MacMillan ..... E02D 29/14 404/25
3,445,973 A 5/1969 Stone
3,534,992 A * 10/1970 Swanson ..... 292/113
3,861,081 A * 1/1975 Maskell ..... 49/70
3,914,911 A * 10/1975 Paasch ..... E03F 5/06 404/4
4,838,732 A 6/1989 Clark et al.
(Continued)

FOREIGN PATENT DOCUMENTS

WO WO 2005075751 8/2005
WO WO 2009/091599 A1 7/2009

OTHER PUBLICATIONS

U.S. Appl. No. 61/996,642, Alder.
(Continued)

*Primary Examiner* — Katherine Mitchell
*Assistant Examiner* — Johnnie A Shablack
(74) *Attorney, Agent, or Firm* — Polsinelli PC

(57) ABSTRACT

A lightweight watertight cover that is easily installed and positively secured in place, which provides a reliable seal to prevent flood water from entering openings such as subway ventilation shaft gratings and other porous openings that serve as entry point for flood water.

21 Claims, 3 Drawing Sheets

(56) References Cited

U.S. PATENT DOCUMENTS 4,988,234 A 1/1991 Henkel et al.
5,379,555 A * 1/1995 Strieb ..... E03F 7/02 4/581
5,527,131 A 6/1996 Salmond et al.
5,941,031 A * 8/1999 Fullwood ..... 52/202
5,954,952 A * 9/1999 Strawser, Sr. ..... B01D 29/01 210/164
6,197,077 B1 * 3/2001 Simmons et al. ..... 55/351
6,205,713 B1 * 3/2001 Thompson et al. ..... 49/465
6,230,455 B1 * 5/2001 Arehart et al. ..... 52/202
6,293,059 B1 * 9/2001 Goodwin ..... 52/202
6,341,455 B1 * 1/2002 Gunn ..... 52/202
6,530,722 B1 3/2003 Shaw et al.
6,681,533 B1 * 1/2004 Doyle ..... 52/107
6,769,834 B1 8/2004 Stange
6,898,907 B2 * 5/2005 Diamond ..... 52/202
6,978,579 B1 * 12/2005 Trinca ..... 52/203
7,074,326 B2 * 7/2006 Singleton ..... E03F 5/0404 210/163
7,100,329 B2 * 9/2006 Pleasants ..... 49/465
7,131,787 B2 * 11/2006 McGinn ..... E03F 5/046 404/4
7,323,028 B2 * 1/2008 Simmons ..... 55/495
7,337,582 B1 * 3/2008 Klotz ..... 49/465
7,387,654 B1 * 6/2008 Byers ..... 55/385.1
7,404,690 B2 * 7/2008 Lukasik ..... E01C 5/18 404/29
7,416,577 B2 * 8/2008 Simmons ..... 55/495
7,455,474 B2 * 11/2008 Tievant ..... E02D 29/1427 404/25
7,481,921 B2 * 1/2009 Kent ..... E03F 1/00 210/164
7,524,414 B1 * 4/2009 Barragan ..... E03F 1/00 210/163
7,805,897 B2 * 10/2010 Holland et al. ..... 52/202
7,842,116 B2 * 11/2010 Simmons ..... 55/480
7,849,645 B2 * 12/2010 Pamboris ..... 52/273
7,879,233 B2 2/2011 Shaw et al.
7,887,257 B2 2/2011 Shaw et al.
7,950,075 B2 5/2011 Evans, Jr. et al.
7,997,554 B2 * 8/2011 Carnevali ..... 248/363
8,002,977 B2 * 8/2011 Shaw ..... E03F 1/00 210/164
8,043,498 B2 * 10/2011 Rueda ..... E03F 1/00 210/164
8,051,568 B2 11/2011 Moody et al.
8,117,686 B2 * 2/2012 Powell ..... A47K 1/14 4/293
8,118,517 B2 * 2/2012 Kelley ..... E02D 29/14 404/25
8,216,453 B2 * 7/2012 Moody ..... E03F 1/00 210/163
8,240,430 B2 * 8/2012 Downey ..... B32B 3/30 181/207
8,556,029 B2 * 10/2013 Downey ..... B32B 3/30 181/284
8,679,328 B2 * 3/2014 Hebert ..... E03F 5/0404 210/163
8,881,640 B2 * 11/2014 Errington et al. ..... 89/36.04
8,950,129 B2 * 2/2015 Motosko et al. ..... 52/203
8,959,839 B1 * 2/2015 Hamlin, III ..... 52/2.22
8,991,119 B1 * 3/2015 Bracci ..... 52/203
9,068,336 B2 * 6/2015 Shaw
9,127,448 B2 * 9/2015 Thomas ..... E03F 5/046
9,267,252 B1 2/2016 Adler et al.
9,315,965 B1 * 4/2016 Adler ..... E04H 9/14
2002/0130070 A1 * 9/2002 Roesner ..... E03F 5/0401 210/163
2004/0154242 A1 * 8/2004 Hudoba et al. ..... 52/202
2004/0200767 A1 * 10/2004 Singleton ..... E03F 5/0404 210/163
2004/0237180 A1 12/2004 Evans, Jr. et al.
2004/0250477 A1 * 12/2004 Butcher ..... 52/3
2005/0000872 A1 * 1/2005 Middleton ..... B01J 20/20 210/163
2005/0262624 A1 12/2005 Evans et al.
2006/0049085 A1 * 3/2006 Parker ..... E03F 5/0404 210/163
2006/0185271 A1 * 8/2006 Christensen et al. ..... 52/202
2007/0000193 A1 * 1/2007 Beaupre et al. ..... 52/202
2007/0028536 A1 * 2/2007 Pandorf ..... 52/203
2007/0101666 A1 * 5/2007 Munch ..... 52/202
2007/0227083 A1 * 10/2007 Skobba ..... 52/202
2007/0234656 A1 * 10/2007 Framer ..... 52/204.5
2008/0006568 A1 1/2008 Moody et al.
2008/0120916 A1 * 5/2008 Borona et al. ..... 49/506
2008/0145150 A1 6/2008 Shaw et al.
2008/0169070 A1 * 7/2008 Mullet et al. ..... 160/369
2008/0296211 A1 * 12/2008 Swan ..... E03F 1/00 210/163
2009/0019797 A1 * 1/2009 Gunn ..... 52/202
2009/0193730 A1 * 8/2009 Pruet et al. ..... 52/222
2009/0241421 A1 * 10/2009 Hay et al. ..... 49/57
2010/0064606 A1 * 3/2010 Devalapura et al. ..... 52/202
2010/0236166 A1 * 9/2010 Tucker ..... 52/202
2013/0036704 A1 * 2/2013 Simmons ..... 52/710
2013/0125469 A1 5/2013 Shin
2013/0185856 A1 7/2013 Powell et al.
2015/0090411 A1 * 4/2015 Pyles et al. ..... 160/368.1
2015/0107170 A1 * 4/2015 Olkin ..... 52/202
2016/0115668 A1 * 4/2016 Halbirt ..... F16J 13/12 49/465

OTHER PUBLICATIONS

U.S. Appl. No. 61/996,103, Alder et al.
U.S. Appl. No. 61/961,046, Alder.
U.S. Appl. No. 61/956,204, Alder.
International Search Report Dated Dec. 4, 2015.
Contract A-369929; The Metropolitan Transportation Aurthority Acting by The New York City Transit Authority.

* cited by examiner

PORTABLE FLEXIBLE SEALING DEVICE FOR GRATED OPENINGS

FIELD OF INVENTION

The present invention relates to a portable flexible sealing device that prevents water or other fluids from entering an underground shaft, pipe, or building through openings which are covered by non-water tight gratings. The invention can be used to prevent unwanted flooding into subways, buildings, storm water systems, and other facilities from tidal storm surges, heavy rain events, water main breaks, etc. The invention could also provide facility or personnel protection from hazardous waste spills or from chemical, biological and/or radiological attacks. This invention provides a reliable cover device and method to render the grated opening watertight in the presence of inches to tens of feet of fluid head pressure, and is securely fastened to prevent the cover device being removed by wind, water action or vandalism.

PRIOR ART

There are prior patents that (WO 2009091599 A1, U.S. Pat. Nos. 6,530,722 B1, 7,887,257 B2) that provide a device to seal holes, but do not include a mechanical system to ensure a positive seal while under wind and/or water loading. Another patent (U.S. Pat. No. 7,879,233 B2) provides details of a vent cover, but its functionality is geared towards filtering unwanted solid matter or debris from entering storm drains, but not preventing the entry of storm water. Another patent (WO 2005075757 A1) is based on a sealing device for drains holes and it relies on filling a center chamber with materials such as sand, metal pellets, etc. to facilitate sealing. Another invention covered in U.S. 7,950,075 B2 described a sealing device based on use of flexible polymeric materials, but it does not include a provision to actively apply force to ensure a water tight seal around drain openings and secure the device in place.

BACKGROUND OF INVENTION

The economic impacts of flood damage are a serious issue around the world. The cost of flood damage is increasing and projected to increase further as the impacts of global climate change are realized. Sea level rise as well as the greater intensity of storms inland have the potential to increase the frequency of flooding in coastal, as well as inland regions. The need for flood mitigation solutions that are quickly applied and effective against all threats witnessed in storms are needed. These devices must not only seal openings against shallow water events, but must also withstand many feet of hydrostatic pressure, and in some cases, withstand loads from hurricane force winds and moving water, and even be tamperproof against vandalism. The portable flexible sealing device of the invention has been created to fill this need.

One example of an immediate need is the protection of subway systems. Subways have ventilation (or vent) shafts which generally open at street level and are covered by rigid metal, or composite, gratings. The subway systems are equipped with pumps and drainage systems that are able to prevent flooding during typical storms. However, many cities are located near bodies of water and are becoming increasingly vulnerable to sea level rise from climate change and from tidal or storm surges. For example, in 2012, Hurricane Sandy caused billions of dollars of flood damage to New York City subway infrastructure due to the storm surge. Although there are many routes of entry for fluids to find their way into a subway system, the vent shafts have been identified as a major source. The portable flexible sealing device of the invention was created to quickly seal subway vent shafts prior to a storm to prevent flooding. Plywood sheets were installed ahead of Hurricane Sandy to prevent water from getting in through vent shafts. However, they were not effective. Several alternative approaches like raising vent shaft entrances above sea level to reduce flooding of tunnels due to storm run-off and rain water are being explored. However, these approaches require changes to the existing vent shafts covers and could prove very expensive, and are not often acceptable to a city's architectural or historical preservation needs.

In addition to coastal transit systems being at risk, climate change has also increased the intensity of storms and rainfall which cause flash flooding. Inland cities and towns all over the world have experienced flooding events which have allowed water to penetrate transit systems, commercial and industrial buildings, and other properties through ventilation, wastewater and other ducting or connecting shafts/pipes. Grated openings come in many forms and can be in numerous orientations, so sealing devices need to be adaptable in size, shape, and effects of gravity.

SUMMARY OF INVENTION

The invention pertains to a sealing device, or cover, for preventing or minimizing the entry of water or other fluids into underground areas, or areas below flood level such as building interiors, that are connected to the surface via an opening that is covered by a grating or a grille. The sealing device can be used to seal openings that are in horizontal, vertical, or in-between orientations relative to ground level. The sealing device functions by sealing the perimeter of the opening being covered via a pliable material that acts as a water tight seal by being compressed against the area surrounding the grating cover.

The sealing device is comprised of a unique segmented assembly of rigid plates encapsulated by a coated fabric that allow it to adapt to irregular surfaces, fit into corners to seal in two planes simultaneously, and be collapsible for transport and storage. The device is a planar structure that can be designed in varying geometrical shapes including rectangular, square, curved and rounded configurations, and has hinge points that enable it to bend and seal openings that are not planer. The main structural components of the sealing device include an arrangement of rigid panels, a flexible membrane that sandwich the rigid panels and make the cover impervious to fluids, anchor assemblies that attach the cover to the grating, rigid ribs that act as a fulcrum, and a pliable perimeter seal on the underside of the cover. The fundamental principle of operation of this device that sets it apart from other flat plate sealing devices is the use of a fulcrum and lever system to exert pressure on the watertight gasket around the grating opening. The rigid plates extend from the perimeter of the cover to the fulcrum, or typically one-third to one-half the distance from the edge of the cover to the center of the cover, but the distance can be scaled to fit any situation. Therefore, the central portion of the cover is only the coated fabric or membrane material, and as such greatly reduces the weight of the assembly.

The anchor assemblies provide a method of securely fastening the cover to the grating, and in conjunction with the fulcrum create a lever function that focuses clamping force onto the perimeter seal. Each rigid section has a fulcrum that rests against the interior portion of the grating.

The holes on the cover assembly that receive the fasteners used to attach the cover to the grate are large enough to facilitate insertion of the fastener through an available opening in the grate. The heads of the fasteners are equipped with a gasket that seals the hole around its perimeter when the fastener is tightened to the grate. The fastener itself resembles a large bolt with a hook at its end. When it is inserted into the hole in the cover the hook catches the bottom of the grate as the bolt is tightened, and the cover is secured in place.

The rigid panels are arranged such that there are gaps or spaces between these panels along the plane of arrangement. These rigid panels are encapsulated between layers of flexible coated textile material which is intimately adhered to either side of the rigid panels. Since the rigid panels are tightly sandwiched between two flexible layers, they form an integrated cover with hinges that are both stiff for sealing and flexible for adapting to surface geometries. The gaps between the plates also reduces the torsional rigidity of the rigid planar structure and maximizes the clamping force on the gasket seal around the perimeter, as well as creating an independent series of perimeter seal compression systems so that the clamping force on the seal will be consistent even if the surface geometry of the grating is not planer. This is important because the land around many grated structures shifts over time and the gratings and their perimeter support features become undulated. This is readily apparent in cities where earth settling or tree roots cause sidewalks with gratings to crack and move out of plane. Without the segmentation of the rigid stiffeners in the cover, the cover would act as a single flat plate that would contact one portion of the grating before the others and negate the ability to put compressive pressure on the seal, and would therefore leak.

The gaps between the rigid panels are supported only by the flexible top and bottom layers and therefore act as hinges. This design ensures control over the location of the hinges. In one of the embodiments for large-area covers, larger gaps in the strategic locations of the cover are incorporated to make the cover foldable for compact storage and easy handling or transportation.

The grate sealing device can be sized to fit any grated opening with a solid surrounding feature such as a rim, with a single device. The device can also be abutted in multiple units to seal non-standard or larger openings that are covered by grating or grilles. This limits the number of different sizes required and simplifies installation by creating universal designs. The sealing of openings that are larger than the size of the vent cover can be achieved by using multiple vents covers in conjunction to the surface area of the opening and by using transitional pieces of impermeable gasket material between the vent covers to seal the area of abutment. The transitional gasket between covers is clamped in place under the perimeter seal on the cover to provide a water-tight join between covers.

The grate sealing device is sufficiently conformal to the grating and to uneven topological surfaces at the edge of the opening at the sealing interface around the device's outer perimeter to allow for a water tight seal. To allow for the grate sealing device to be easily hand carried to the point of use, it is made from lightweight materials including a combination of flexible coated textiles or membranes, rigid composite or metal plates, and flexible gasket materials in the form of foams or extrusions.

DETAILED DESCRIPTION OF THE PREFERRED EMBODIMENTS

Figure 1:
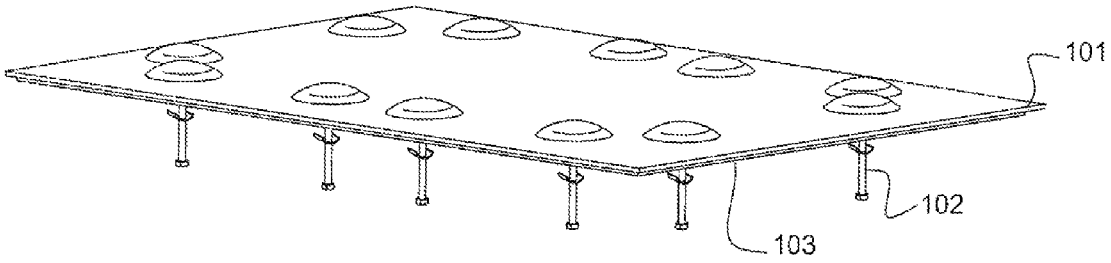
FIG. 1 illustrates the side view of the vent cover with anchors in position before installation.

FIG. 1 shows the side view of one embodiment of the vent cover. in this embodiment, the vent cover is rectangular in shape with all of its components including the rigid laminate 101, anchor assembly 102, rigid rib 301 at the fulcrum point, and the compressive gasket seal 103 that is attached at in a continuous line around the edges of the rigid laminate to create a barrier for entry of liquid media and other contaminants against which a seal is desired. The vent cover has two sides in relation to its installation and function. The side of the vent cover that has the anchor plate 201 is the top side and the side which has the gasket seal 103 and rigid rib 301 is the bottom side of the vent cover.

Figure 2:
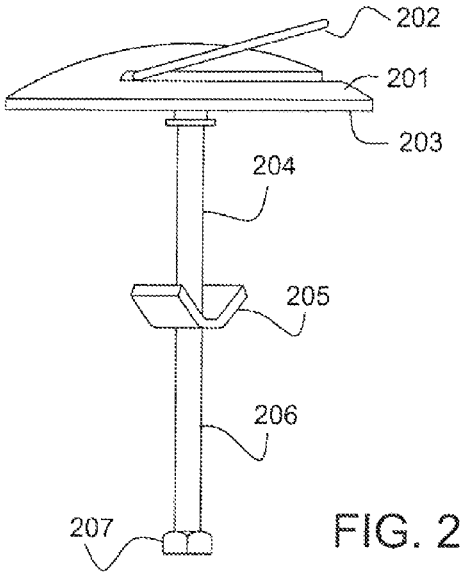
FIG. 2 shows the schematic of the anchor in vent cover.

FIG. 2 shows a perspective view of an embodiment of the anchor assembly. The anchor plate 201 is connected to the bolt 206. In this embodiment a holding pin 202 is attached into the anchor plate to facilitate positioning the anchor assembly between the bars of gratings or grilles 210, but it is not necessary to the function of the anchor assembly and can be left out, The anchor plate 201 is positioned between the gasket seal 103 and the rigid rib 301, which acts as the fulcrum point on the vent cover. In this embodiment, the anchor plate 201 has a layer of compressive material 203 underneath that acts as a seal for the anchor assembly when inserted into the hole in the rigid laminate. This anchor plate 201 and compressive material 203 together perform the functions of evenly distributing the force from clamping of the anchor plate against the top surface of the vent cover and also acts as a seal against water during flooding. This layer is held in place in the intended position of the anchor assembly by a retainer ring 204. The section of the anchor assembly that has screw threads 206 to facilitate the bolting of the anchor assembly also has a hook 205 and a termination feature 207 to prevent the hook from accidently sliding from the anchor assembly.

Figure 3:
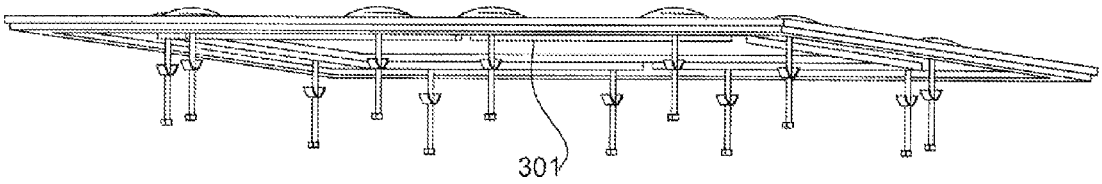
FIG. 3 shows the view from the bottom in relation to the installed position of the vent cover.

FIG. 3 shows the bottom view of the vent cover. The rigid rib 301 is positioned at an optimum distance from the fastener insertion hole in the cover with the objective to transferring maximum force to the gasket 103 when the fastener is tightened, which is directly linked to how effective the gasket seal is in minimizing the entry of water through the grated opening.

Figure 4:
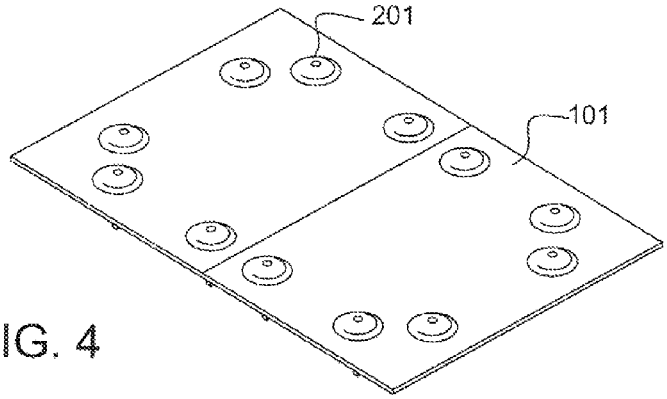
FIG. 4 shows the top view of the vent cover with anchors in position for installation.

FIG. 4 shows show the top view of the vent cover with a location of the anchor assembly represented by the anchor plates.

Figure 5:
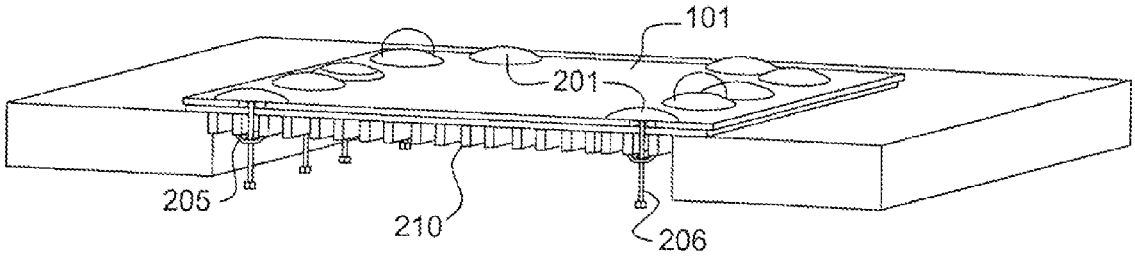
FIG. 5 shows the cross-sectional view of a vent cover installed over a grating of vent opening.

FIG. 5 shows the cross-section view of the cover in its installed position over the grating. The hooks are positioned and locked against the bars of the grating.

Figure 6:
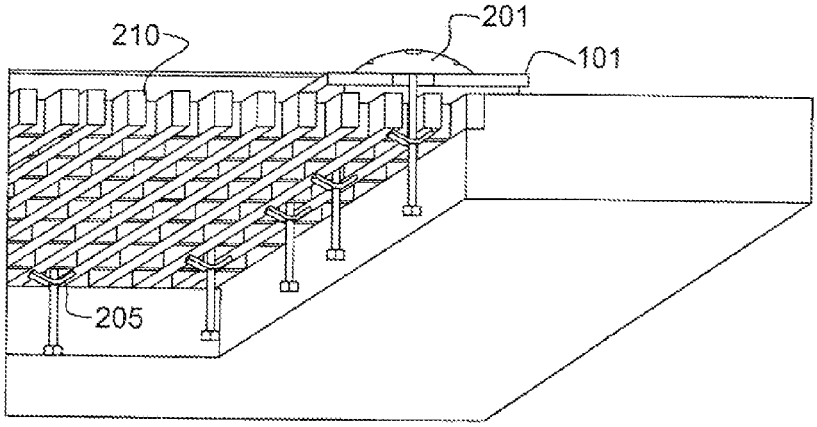
FIG. 6 shows the position of the anchors with hook engages with the grating of vent opening.

FIG. 6 shows the close-up view of the hooks in the anchor assembly locked in with the grating bars.

Figure 7:
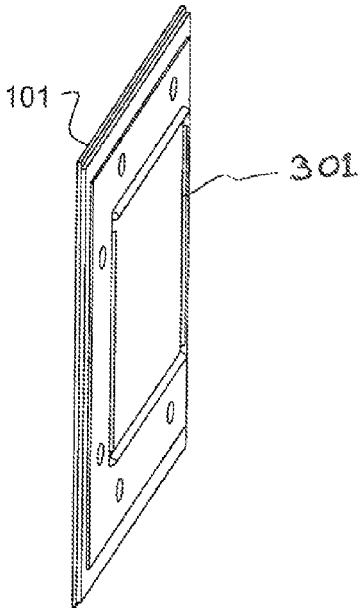
FIG. 7 shows the vent cover in a folded configuration without the anchors.

FIG. 7 shows the vent cover folded at the center to allow for easy transportation and installation.

We claim:

1. A portable flexible cover device with a seal on a periphery of the cover device, that is sized and shaped to seal a grated opening from entry of water into at least one selected from the group consisting of buildings, underground architecture and systems;

said portable flexible cover device comprising a segmented assembly of rigid plates, the segmented assembly of rigid plates being encapsulated by at least one selected from the group consisting of a coated fabric and membrane that allow the flexible cover device to adapt to irregular surfaces, wherein the rigid plates do not encompass all of the area of the portable flexible cover device such that at least a central portion of the portable flexible cover device is free of rigid plates and comprises only the coated fabric or membrane;

a seal on the periphery of the portable flexible cover device;

the flexible cover device additionally comprising at least one rigid rib, the at least one rigid rib being positioned beneath at least one of the rigid plates;

and a series of anchors; at least one of the series of anchors being positioned between the at least one rigid rib and the seal and passing through the rigid plate;

whereby the application of a compressive force on at least one of the anchors against at least one of the rigid plates causes the at least one rigid rib to act as a fulcrum and the rigid plate to act as a lever to exert pressure on the seal of the portable flexible cover device.

2. The device of claim 1, wherein the portable flexible cover device comprises a segmented assembly of rigid plates encapsulated by a coated fabric.

3. The device of claim 1, wherein the shape of the cover device is quadrilateral and the cover device comprises at least four rigid ribs; each of the four rigid ribs lying parallel to one of the edges of the quadrilateral and further comprising a series of anchors, each of the series of anchors lying between one of the four rigid ribs and the seal; whereby the application of a compressive force on each of the anchors against the rigid plates causes each rigid rib to act as a fulcrum and each rigid plate to act as a lever to exert pressure on the seal of the portable flexible cover device.

4. The device in claim 3, wherein fasteners are provided to attach each of the anchors of the portable flexible cover device to a grating such that the portable flexible cover device will remain in place when exposed to any one from the group consisting of high winds, rushing water and debris impact.

5. The device in claim 1, in combination with at least one selected from the group consisting of flat gratings and gratings that are non-flat gratings.

6. The device of claim 1, wherein the perimeter seal conforms to topographical irregularities around a grated opening.

7. The device of claim 6, wherein the perimeter seal is comprised of at least one selected from the group consisting of single or multiple foam or extruded flexible materials.

8. The device of claim 1, wherein the perimeter seal comprises a compliant material that conforms to a surface topography and creates a water tight seal when under compression.

9. The device of claim 1, wherein the cover device may be used to seal a grated opening that is located in any one of horizontal, vertical, or intermediate position relative to ground level.

10. The device of claim 1, wherein the portable flexible cover device can be folded one or more times for compact storage or transport.

11. The device of claim 1, wherein the perimeter seal will maintain its sealing function with hydrostatic pressure of several inches to several feet of water.

12. The device of claim 1, wherein the perimeter seal is water tight for several days allowing for the scenario of extended periods of use.

13. The device of claim 1, in combination with a second cover device according to claim 1, wherein the portable flexible cover device and the second cover device can be abutted adjacent one another with gasket materials under the abutments.

14. The device in claim 1, wherein the rigid plates comprise laminated rigid plates.

15. The device of claim 1, further comprising a compressive material between the at least some of the series of anchors which each pass through a hole in both the at least one of the rigid plates and the coated fabric or membrane of the portable flexible cover device and the coated fabric or membrane, wherein the compressive material seals the holes; and, the at least some of the series of anchors are attachable to the grating below the portable flexible cover device such that the anchors, when tensioned against the at least one of the rigid plates, compress both the peripheral seal to seal the periphery of the cover device and the compressive material to seal the holes.

16. The device of claim 1, wherein the rigid plates extend from the perimeter of the cover to at least a third of the way to the center of the cover.

17. The device of claim 1, wherein the rigid plates extend from the perimeter of the cover to at least a half of the way to the center of the cover.

18. The device of claim 1, wherein there are at least two rigid ribs.

19. The device of claim 1, wherein there are at least four rigid ribs.

20. The device of claim 1, wherein the portable flexible cover device can be folded one or more times and in two or more planes.

21. A portable flexible cover device comprising at least one rigid plate encapsulated by a coated fabric or membrane, the cover device further comprising a peripheral seal; the cover device being sized and shaped to attach over a grated opening and seal the opening from entry of water into at least one selected from the group consisting of buildings, underground architecture and systems; a series of anchors to hold the cover device over the grated opening; and at least one rigid rib positioned beneath the at least one rigid plate; at least some of the anchors in the series of anchors being positioned between the at least one rigid rib and the peripheral seal, such that the at least one rigid rib, under compression of the plate by at least one of the series of anchors acts as a fulcrum and the at least one rigid plate acts as a lever to compress the perimeter seal.

* * * * *